US006816806B2

(12) United States Patent
Kocimski

(10) Patent No.: US 6,816,806 B2
(45) Date of Patent: Nov. 9, 2004

(54) METHOD OF CHARACTERIZING A SEMICONDUCTOR SURFACE

(75) Inventor: Stanislaw M. Kocimski, Goleta, CA (US)

(73) Assignee: Veeco Instruments Inc., Woodbury, NY (US)

( * ) Notice: Subject to any disclaimer, the term of this patent is extended or adjusted under 35 U.S.C. 154(b) by 177 days.

(21) Appl. No.: 09/871,287

(22) Filed: May 31, 2001

(65) Prior Publication Data

US 2002/0183963 A1 Dec. 5, 2002

(51) Int. Cl.[7] ..... G06F 15/00
(52) U.S. Cl. ..... 702/167; 702/150; 438/14
(58) Field of Search ..... 702/150, 153, 702/155–159, 166, 167, 170; 438/14, 7–9; 382/132, 274

(56) References Cited

U.S. PATENT DOCUMENTS 4,793,895 A 12/1988 Kaanta et al.
5,723,874 A 3/1998 Baker et al.
5,808,735 A * 9/1998 Lee et al. ..... 356/237.2
5,836,807 A 11/1998 Leach
5,854,851 A * 12/1998 Bamberger et al. ..... 382/132
5,874,318 A 2/1999 Baker et al.
5,946,407 A * 8/1999 Bamberger et al. ..... 382/132

OTHER PUBLICATIONS

Davis baselt, Atomic force microscopy, California Institute of technilogy, copy right 1993, 10 pages.*

* cited by examiner

*Primary Examiner*—Bryan Bui
(74) *Attorney, Agent, or Firm*—Boyle Fredrickson Newholm Stein & Gratz S.C.

(57) ABSTRACT

A method of characterizing a sample surface having a surface anomaly region includes the steps of profiling the sample surface to generate surface characteristic data, and generating a histogram based on the profiling step. Then, the method measures a surface anomaly in the surface anomaly region based on the generating step. The method further includes the step of selecting a zone of interest from the surface characterization data. The zone of interest preferably includes the surface anomaly region, wherein the surface anomaly region includes one of erosion and dishing. Preferably, the histogram includes a first peak corresponding to a generally planar portion of the sample surface, and a second peak corresponding to the surface anomaly. Moreover, the measuring step includes determining a distance between the first and second peaks, the distance being indicative of the depth of the surface anomaly.

33 Claims, 8 Drawing Sheets

METHOD OF CHARACTERIZING A SEMICONDUCTOR SURFACE

FIELD OF THE INVENTION

The invention is generally directed to the field of semiconductor manufacture and, more particularly, to a method of making accurate, reliable and reproducible semiconductor surface characterization measurements, including identifying surface anomalies such as dishing and erosion regions, notwithstanding the presence of noise signals in the surface characterization map.

BACKGROUND OF THE INVENTION

In semiconductor fabrication, there is an ever-present need for methods to further improve reliability, yield and cost.

Semiconductor manufacturing processes includes the steps of, for example, etching a plurality of spaced-apart trenches into a surface layer of a conventional dielectric material such as a silicon-based wafer. Once the trenches are formed, the process typically includes applying or plating, on the surface layer, a layer of an electrically-conductive metal such as copper, which also fills the trenches. The trench-filled and metal-covered surface of the dielectric wafer is subsequently polished, typically by a conventional process known in the art which employs a known form of chemical mechanical polish, down to the dielectric layer.

The dielectric layer, typically an oxide, is not as easily polished away during the chemical mechanical polishing process as the surface-deposited, trench-filling metal, principally because the metal is "softer" than the oxide. As a result, the oxide surface tends to serve as a mechanical "stop" during the chemical mechanical polishing process. Metal remaining in the trenches thus forms a pattern of conducting paths. Note that the term "dielectric," as used herein, is to be understood to mean a substance which contains few or no free electrons and which has an electrical conductivity that is so low as to be considered an insulator.

One problem encountered in the above-described semiconductor manufacturing process is known as "dishing," which occurs when a pad, used in the chemical mechanical polishing process, deforms into the metal-filled trench as a result of pressure applied by the pad in conjunction with the resistance presented by the oxide surface. As is appreciated by those skilled in the art, the depth of dishing into a trench may be deeper for wider trenches. Notably, anything other than minimal dishing is generally undesirable, since the result may adversely affect the desired electrical properties and/or functions of the metal deposited in the trench.

Another problem that may be encountered in conventional semiconductor manufacturing processes is "erosion" which occurs when a pad, used in the chemical mechanical polishing process, wears away some of the oxide surface as a result of the pressure applied by the pad opposite the oxide surface. It can be well appreciated that erosion is particularly undesirable for multiple alternating layers (along the semiconductor surface) of metal and dielectric material, as erosion of the dielectric material increases the risk of a short between adjacent metal layers. Thus, erosion is particularly problematic in semiconductor wafer structures having a relatively high number of tightly-packed metal-filled trenches with relatively thin walls of dielectric oxide wafer material between adjacent metal-filled trenches.

Similarly, in the event that the trench filling metal is harder than the oxide, the "eroded area" can actually rise above the oxide surface, according to a phenomenon known as "negative erosion." More particularly, in this case, the polishing process removes the oxide faster than the metal due to the metal being generally harder, causing dishing in the oxide and the removal of the substrate "surface area" (see, for example, 18 in FIG. 3, discussed below) faster than the alternating metal layers, thus compromising the desired planarity of the resulting semiconductor surface.

Overall, erosion in conjunction with dishing may further adversely affect desired electrical properties and/or functions of the metal deposited in the trenches. In general, it is desirable for a semiconductor manufacturer to know when dishing and/or erosion is occurring, as well as the rate and amount of such dishing and/or erosion. Accuracy and precision, when locating the semiconductor upper surface as well as the bottom of dips due to dishing and erosion, must be statistically satisfactory, reliable and reproducible. Conventional methods are not.

A problem introduced when attempting to characterize the dishing and erosion phenomena is "noise." Noise problems occur, for example, when dust and other air-borne and/or electrically-charged particles adhere to the semiconductor surface. In the context of the preferred embodiment, the "noise"-based problem affects the accuracy and efficiency of the dishing and/or erosion measurements. For example, while the noise-causing particles are often microscopic, it is important that a typical surface scan profile may include a total distance of about 2–5 millimeters along the semiconductor surface, involving perhaps 200–250 thousand points or "areas" of interest (or "regions"), wherein a vertical depth measurement for "dishing" purposes may be about 150–200 nanometers, and a typical vertical depth measurement for "erosion" purposes may be about 30–40 nanometers, wherein both depth measurements are made relative to the semiconductor surface.

One current method of profiling and characterizing a semiconductor surface after the chemical mechanical polishing procedure, includes scanning across a sample surface of the semiconductor with a conventional metrology instrument, and then generating a plot or map of the data. Such plots are typically presented to a semiconductor-manufacturing operator for analysis.

Conventional statistical averaging of the data, which attempts to correct for any noise that may be present, has not yet resulted in statistically satisfactory accuracy and precision, nor the attendant reliability and reproducibility of the semiconductor characterization information that is currently being sought by many semiconductor manufacturers. One such method averages the metrology data, including the noise signals, in an attempt to accurately determine the peaks. The averaging method is unreliable because it introduces error when noise signals are averaged.

Another method involves utilizing percentiles of the measurement data, including noise signals, in an attempt to determine peaks corresponding to dishing and erosion regions. The percentile method, unreliable because, like the averaging method, the noise signals must be accounted for when determining surface anomaly information, is not readily reproducible for the reason that an operator must exercise judgment regarding what percentile value to set any particular reading. The operator typically selects a level above or below which a certain percentage of the surface characterization points occur. For example, if the operator selects a particular depth, the percentile method may determine that 95% of the points are above that depth, thus indicating an extreme depth. However, in this example, the issue becomes whether the "95% level" corresponds to the low peak, indicating that the other 5% of the points may correspond to, for example, noise, or whether the level should be set lower to "catch" the peak. Clearly, this involves some guess work on the part of the operator, and often times will require some quantifying of the noise present in the data.

In some known scanning operations, information is obtained, stored and analyzed regarding the top surface (or reference) of the sample surface as well as deviations (e.g., dishing and erosion data) therefrom and noise information is extracted. FIG. 1 illustrates typical topography data resulting from a scan of a semiconductor sample, and in particular, dips and spikes due to noise. The topography, and thus the noise signal (N.S.), runs from left to right along the scan direction (S.D.), as shown. Several spikes (S1, S2, S3, S4) extend upwardly from the smaller noise signals, and dips (D1, D2, D3) extend downwardly. Noise affects determination of the "actual" surface, as influenced by noise, is illustrated in FIGS. 2A and 2B, depicting actual surface (FIG. 2A) and probability (FIG. 2B).

In particular, for a perfectly flat reference surface (R.S.), for reasons mentioned above, the use of conventional surface determination methods will typically result in there being a noise signal (N.S.) which is spaced above (A) or below (B) the reference surface, as is shown. As appreciated by those skilled in the art, noise may arise from "actual" or "true" defects (e.g., cracks, pits and ridges) as well as "false" defects (e.g., adhered particles) along the surface of the semiconductor scan region. Therefore, to investigate many such noise signals, conventional methods and techniques are frequently employed to generate a probability curve (P) (FIG. 2B), that is based upon the noise signals, for the purpose of producing statistically reliable "most likely" data relative to "actual" or "true" location of the reference surface. For example, conversion of the noise signals into digital data may result in the production of the probability curve (P).

With further reference to FIGS. 1A and 1B, and as is well known for so-called "normal" distribution models, will result in the so-called "T" distribution being used statistically to verify the "actual" or "true" location of the reference surface of the semiconductor. Further in that regard, a variety of other statistical models are well known (e.g., Gaussian distribution, Poisson distribution, the so-called "F" distribution, Chi-squared distribution, Hypergeometric distribution, and so forth). Such and other statistical models may be used, and frequently are used, by those skilled in the art. Generally, those employing such statistical methods are known to use "standardized" tabulated data to verify that information of concern to the semiconductor manufacturer appears in the "one minus alpha" or central region of the probability curve (P) and not along the so-called "one-half alpha" or trailing-edge margins of the curve, as is depicted in the plot of FIG. 1B.

With continued reference to FIG. 1, spikes pose a special problem, as many spikes are known to arise from a single-point surface defect, generally with no immediately-surrounding surface region information being present to indicate as to whether the defect is actual or "false." Conventional methods and techniques to account for spikes may result in averaging-in false information or disregarding "actual" or "true" information, either of which impacts the value of the information that results. In particular, known systems that minimize or otherwise quantify this noise data with such complex methods are computationally intensive, and are relatively imprecise according to present standards.

As noise introduces uncertainty into measurements involving, for example, the subtraction of a dish and/or erosion depth location from a semiconductor surface location, it would therefore be desirable to be able to minimize or otherwise eliminate the effects of noise from such semiconductor characterizing measurements. High accuracy, reproducibility and reliability of the data should be assured so as to introduce a higher degree of certainty into the measurements. Therefore, the art of characterizing semiconductor surfaces was in need of a method that identifies surface anomalies, including dishing and erosion data, and characterizes the anomalies with respect to amount and rate of occurrence. Further, the method should determine the surface anomaly information in a reliable and in a readily reproducible manner, independent of the negative effects due to noise signals in the surface measurements.

OBJECTS AND SUMMARY OF THE INVENTION

One object of the present invention is to provide a method that enables a semiconductor manufacturer to determine an amount of dishing during process.

Another object of the present invention is to provide a method that enables a semiconductor manufacturer to determine the rate of dishing.

Yet another object of the present invention is to provide a method that enables a semiconductor manufacturer to determine the amount of erosion during process.

Still another object of the present invention is to provide a method that enables a semiconductor manufacturer to determine the rate of erosion.

A further object of the present invention is to provide a method that enables a semiconductor manufacturer to minimize or eliminate the effect or noise signals on the semiconductor characterizing measurements, for assuring high accuracy, reproducibility and reliability of the data, thereby introducing a high degree of certainty into the measurements.

The preferred embodiment of the present invention determines surface anomaly information, particularly dishing and erosion information relating to semiconductor manufacture, by virtually eliminating the effects of noise from the determination of dishing and erosion. The method takes advantage of the fact that the surface characterization data corresponding to either surface regions or anomaly regions will be much more frequent than individual occurrences of noise associated with the topography data of the sample surface.

According to a first aspect of the preferred embodiment, a method of characterizing a sample surface having a surface anomaly region includes the steps of profiling the sample surface to generate surface characteristic data, and generating a histogram based on the profiling step. Then, the method measures a surface anomaly in the surface anomaly region based on the generating step.

According to a further aspect of the preferred embodiment, this method includes the step of selecting a zone of interest from the surface characterization data. The zone of interest preferably includes the surface anomaly region, wherein the surface anomaly region includes one of erosion and dishing.

According to yet another aspect of the preferred embodiment, the histogram includes a first peak corresponding to a generally planar portion of the sample surface, and a second peak corresponding to the surface anomaly. Further, the measuring step includes determining a distance between the first and second peaks, the distance being indicative of the depth of the surface anomaly.

In a still further aspect of the preferred embodiment, a method that measures dishing values and erosion values associated with surface topography data generated by scanning a semiconductor surface includes the steps of: (A) generating a histogram of a portion of the surface profile data corresponding to a first zone of interest; and (B) smoothing the histogram of the generating step to produce a smoothed curve having a peak corresponding to one of a dishing value and an erosion value.

According to another aspect of the preferred embodiment, the first zone of interest includes dishing and erosion data, and the smoothed histogram includes first, second and third peaks corresponding to a reference surface, an erosion value and a dishing value, respectively.

In a still further aspect of the preferred embodiment, a method for measuring dishing values and erosion values of a semiconductor surface by scanning the surface to obtain surface profile data that contains either dishing data or erosion data or dishing and erosion data, all referenced to surface data, includes the steps of leveling the surface profile data and generating a histogram of a portion of the leveled surface profile data corresponding to a first of a plurality of zones of interest. Then, the method includes smoothing the histogram of the generating step to produce a smoothed curve having a maximum value corresponding to an erosion value or a dishing value. Finally, the method includes repeating the generating and smoothing steps relative to each of the remainder of the plural zones of interest to produce smoothed curves corresponding to an erosion value or a dishing value or both for each of the remainder of the plural zones of interest.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 3:
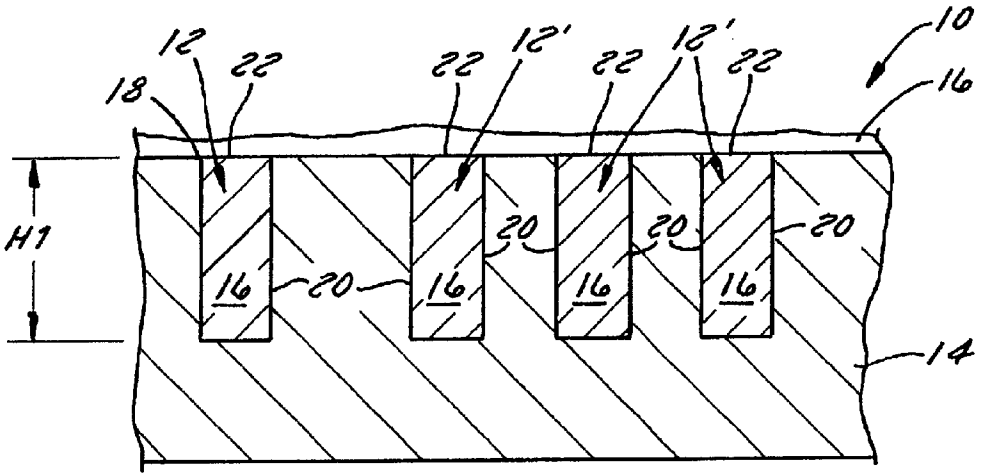
FIG. 3 is a schematic broken away cross-sectional view of a sample, on an enlarged scale.

FIG. 3 is a partially-fragmented cross-sectional view of a sample 10 (e.g., semiconductor), on an enlarged scale, and a plurality of widely spaced-apart trenches 12, and some more tightly packed trenches 12' , etched in a substrate 14. An electrically-conductive metal 16 is shown deposited along a top surface 18 of substrate 14, thus filling the trenches 12 and 12'. A corresponding plurality of electrically-insulative wafer side wall portions 20 of substrate 14 separate trenches 12 and 12'. A result of such spatial arrangement and construction is the plurality of alternating layers of substrate 14 and metal 16 along the upper surface of semiconductor 10, as shown in FIG. 3. Notably, substrate 14 may comprise a dielectric made of a silicon oxide material, while the metal plating 16 is, for example, copper.

Figure 4:
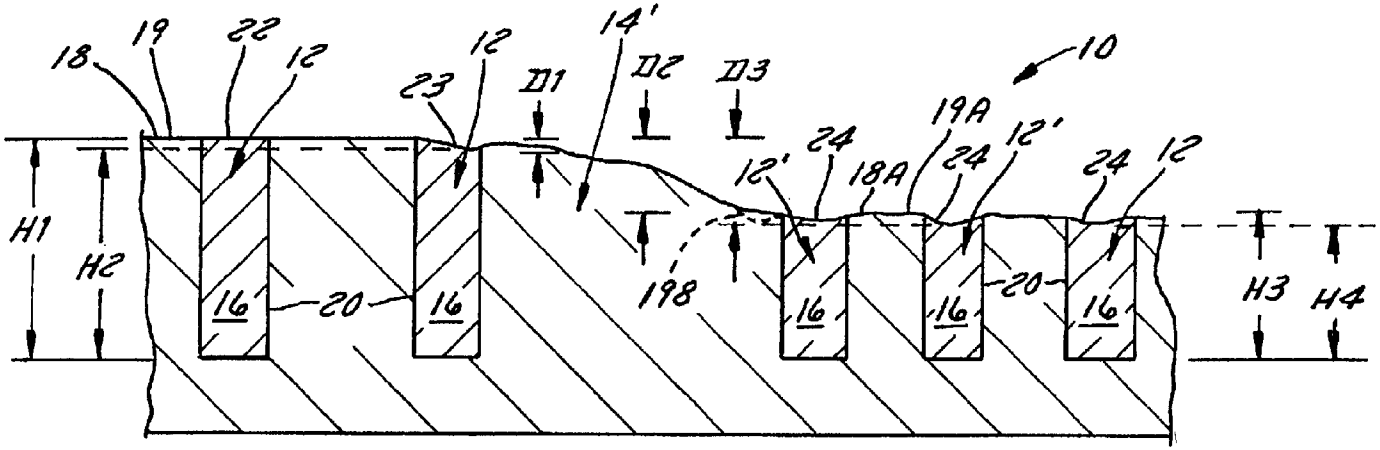
FIG. 4 is a schematic broken away cross-sectional view of a sample before and after a CMP polishing process, illustrating dishing and erosion of the sample surface.

Turning to FIG. 4, a partially-fragmented cross-sectional schematic view of the semiconductor sample 10, with an intermediate portion of the semiconductor 10 removed, schematically depicts "dishing" and "erosion" resulting during the manufacturing process; for example, during the step of polishing the deposited metal layer. Ideally, an upper surface 22 of polished metal 16 is at approximately the same level as the side wall upper surface 19 of semiconductor surface 18 upon completion as the CMP polishing process. As mentioned previously, it is desirable that no erosion of substrate 14 at the substrate/metal interface occurs. However, what often happens upon completion of the CMP process is a reduction in the depth from H1 (of at least one of the more widely spaced trenches 12) to H2 due to, for example, a single dishing (discussed in detail below). Further, the trench height may be reduced even further, for example, from H1 to H3 or H4 (heights associated with more tightly packed trenches 12'), as shown in FIG. 4, due to additional dishing and erosion of upper surface 18 of substrate 14 and upper surface 22 of metal 16 of semiconductor 10.

As a result, the height difference of the trenches before and after the CMP process, in one instance, is H1–H2, or D1, as shown in FIG. 4. D1 is a measure of a single dishing anomaly, which has an amplitude that is directly reflected in the surface characterization map, i.e., profile, shown in FIG. 5. Notably, in this regard, trench depths (H1–H4) are discussed for illustrative purposes only, and are not actually measured.

The height difference of the trenches due to erosion of the sample surface 18 to 18A is an amount equal to H1–H3, or D2. Note, however, that erosion is of the entire sample surface 18, including trenches 12' and oxide 14, and that H1–H3 is merely illustrative of the erosion value. Next, dishing of the eroded surface 18A is illustrated as a reduction in trench depth H3 to a value equal to, for example, H4, at its low peak, as shown in FIG. 4. Again, dishing occurs when upper surface 22 of metal 16 is worn away during the CMP process, thus creating a dip, shown schematically as generally bowl-shaped surface 23 or 24. Note that dishing surfaces 23, 24 are shown bowl-shaped for presentation purposes only, and actual dishing regions may not be continuous across trenches as illustrated. Overall, as a result of both dishing and erosion, trench depth is reduced by an amount (at its low peak) labeled D3.

After the CMP polishing process levels the plurality of spaced-apart metal-filled trenches 12 to substantially the upper surface 18 of side walls 20 of trenches 12, there are hundreds of alternating layers of dielectric and metal extending horizontally across the sample surface 18. Initially, a metrology instrument such as a scanning probe microscope (SPM) or a profiler is employed to make topography measurements of the sample (e.g., a semiconductor such as that shown in FIGS. 3 and 4), as described in further detail below. Based on the data obtained thereby, referring now to FIG. 5, a plot or plot 30 characterizing the sample surface is generated. On the plot, semiconductor surface depth or topography is presented for data gathered from a one-dimensional scan across a sample, e.g., sample 10 in FIGS. 3 and 4. The vertical axis of these topography plots or maps indicates depth in nanometers (nm), while the horizontal axis indicates scan position in millimeters (mm).

Figure 5:
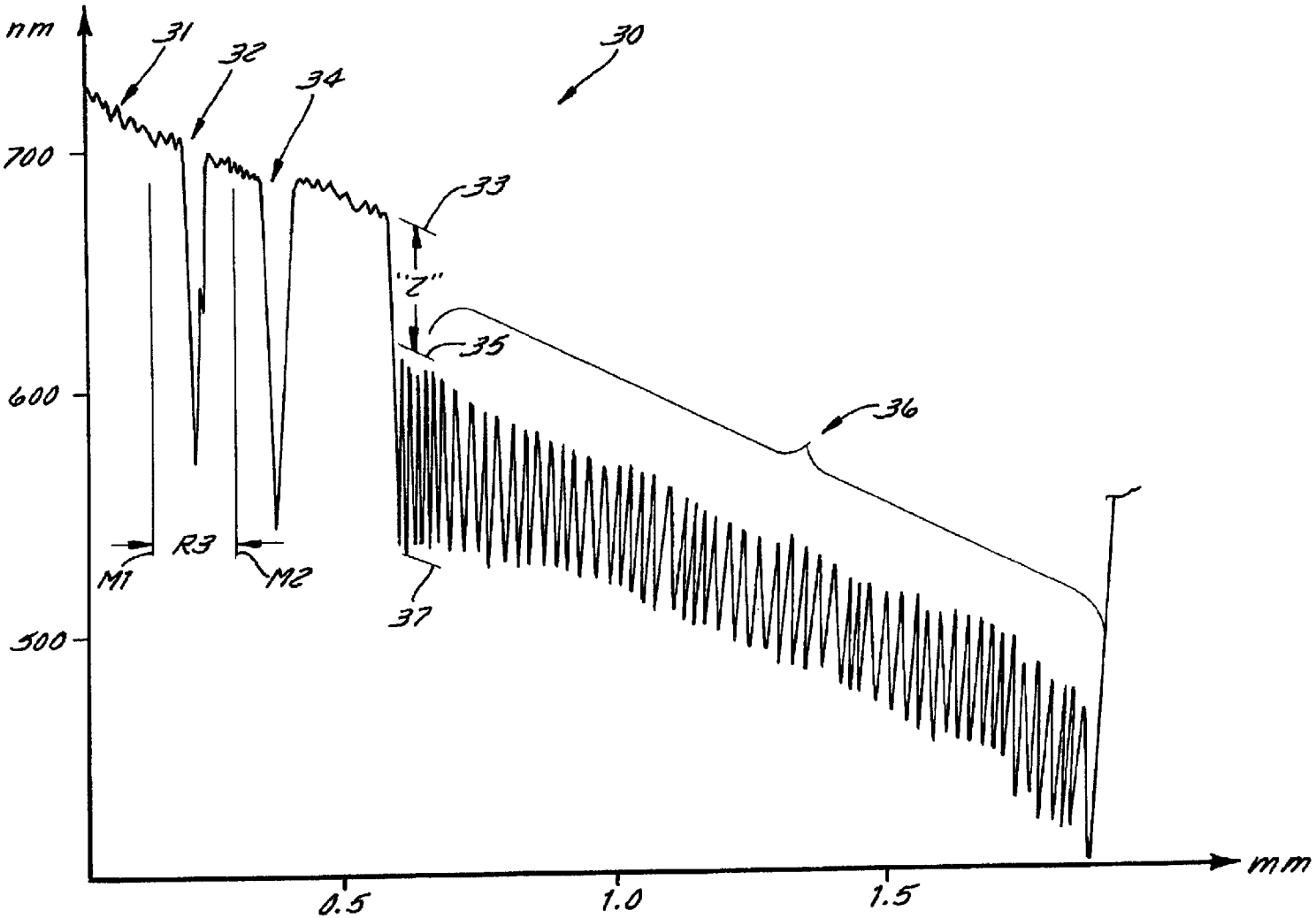
FIG. 5 is a plot of the topography of a surface of a semiconductor sample that is dished and eroded, and where the sample surface is slightly tipped.

With further reference to FIG. 5, plot 30 includes illustrative dips 32 and 34 that are representative of dish depth (e.g., as represented by surface regions 23 in FIG. 4) into trenches 12 relative to upper surface 18 of semiconductor 10. FIG. 5 also illustrates an erosion and multiple dishing zone of plurality of closely spaced trenches 12', or region 36 (e.g., as represented by surface regions 24 in FIG. 4). Again, erosion of the semiconductor surface 18 is an overall reduction of the height of the sample surface (e.g., from 18 to 18A an amount D2 as shown in FIG. 4) along both the dielectric sidewall top surface and top surface of the deposited metal. In FIG. 5, erosion results in a reduction in surface height from a level marked 33 (corresponding to, for example, surface 18 in FIG. 4) to generally a level marked 35, (corresponding to, for example, surface 18A in FIG. 4), which is a distance "Z." Moreover, multiple dishing in FIG. 4 is a reduction in the new surface height labeled 35 in FIG. 5, to a level marked 37 (corresponding to, for example, surfaces 24 of metal filled trenches 12' in FIG. 4). The distance between level 35 and 37 is a direct measure of multiple dishing, e.g., a reduction in trench depth from H3 to H4 in FIG. 4, as discussed above.

Note that the data may be characterized by a slight downward slope, from left to right along the scanned path. This is typically caused by the semiconductor wafer being tilted relative to the metrology instrument (not shown). However, such sloping of the horizontal axis is not critical to semiconductor surface characterization. To facilitate ready analysis, as described in further detail below in conjunction with FIG. 6, the horizontal scan path is preferably automatically leveled during the semiconductor surface characterization procedure.

To avoid having to account for noise information in the characterization of the sample surface as described above, the method of the preferred embodiment utilizes histograms generated from surface topography data. A flow chart illustrating a method of measuring dishing and erosion phenomena is shown in FIG. 6 in conjunction with the schematic data plotted in FIGS. 7–10.

Figure 6:
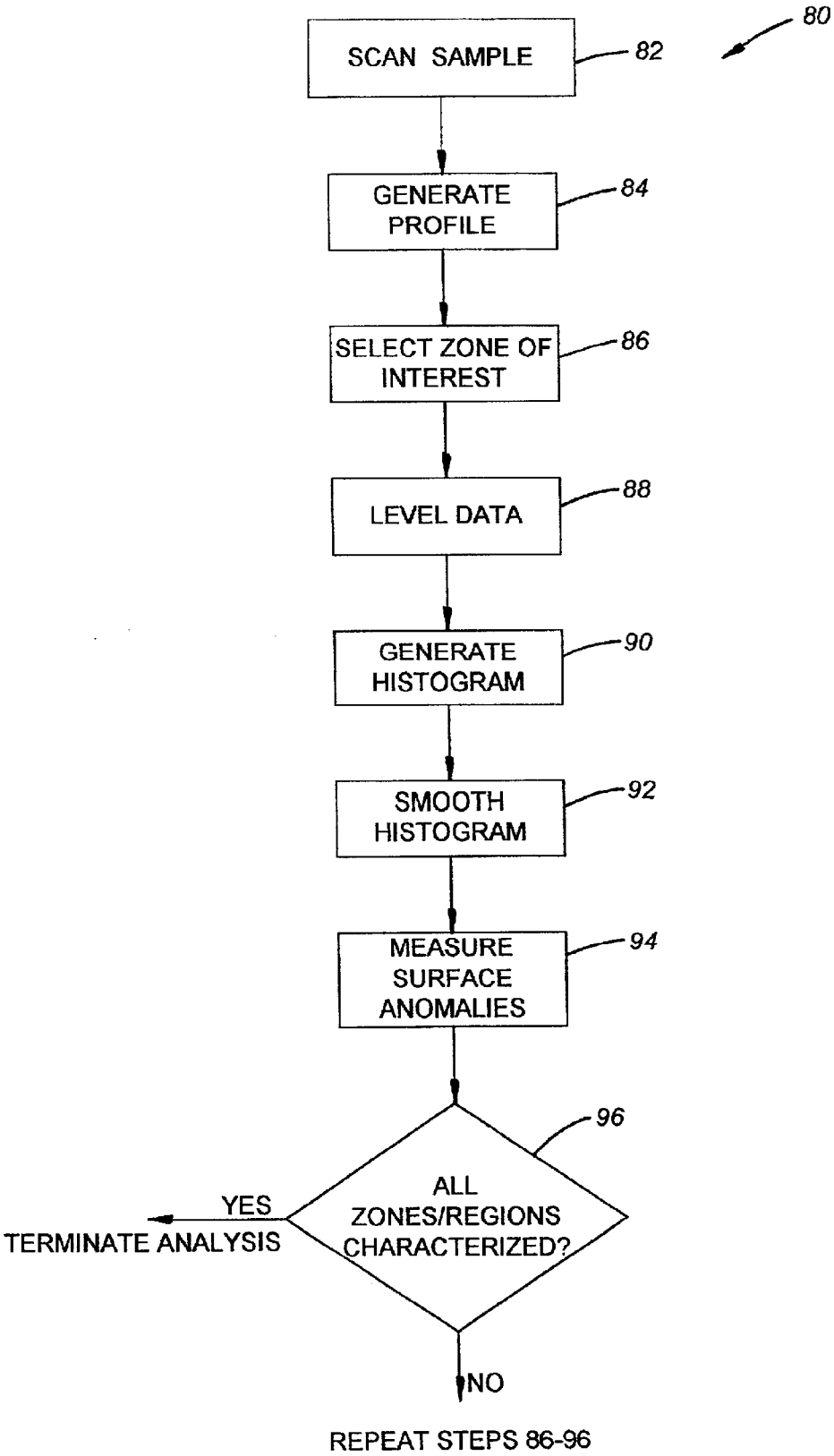
FIG. 6 is a flow chart illustrating a method of determining dishing and/or erosion of a semiconductor according to a preferred embodiment.

FIG. 6 is a flow chart illustrating a method 80 of the preferred embodiment. The first step is to scan the semiconductor surface (Step 82) and thereafter obtain or generate a profile (FIG. 5) for the sample surface being analyzed and characterized in Step 84. Such a profile may be of the entire surface or only a select portion thereof. Then, in Step 86 a portion of the surface data (e.g., topography) is selected. This may be done manually by the operator by setting electronic markers around the region of interest, or automatically. A region of interest, in general, typically contains an upper surface zone and a dishing zone and/or an erosion zone. Thus, a region of interest (for example R3 in FIG. 5) may include an upper surface zone on both ends, where the pair of markers M1 & M2 are set (shown in FIG. 5), and a single or series of dishing and/or erosion zones therebetween.

Then, in Step 88, the data associated with the region of interest is leveled. Notably, leveling the region of interest is understood to mean leveling the data, not leveling the sample. Leveling the data is important in this embodiment because establishing a reference, preferably to the sample surface, is required to make dishing/erosion measurements. Alternatively, although not preferred, the degree to which the data is "non-level" could be measured and accounted for when characterizing the dishing and erosion regions. Note that the steps of generating a profile (Step 84) and leveling a region of interest (Step 88) may be done using conventional algorithms designed to analyze and characterize semiconductor surface regions. The regions of interest may include, a single dishing zone (FIG. 7), an erosion and multiple dishing zone (FIG. 9), or another zone characterized by having dishing and/or erosion regions.

Next, in Step 90, method 80 includes generating a histogram of the isolated and leveled data. Then, the histogram is preferably "smoothed" or filtered in Step 92, again using known methods and techniques to produce a smoothed curve (see FIGS. 8 and 10). The data is preferably smoothed because method 80, by analyzing the data using histograms, is merely looking for the depths which correspond to the greatest number of data points (i.e., the "most likely" depth.) As a result, because individual data points on the histogram are not critical to the dishing/erosion calculation in the preferred embodiment, noise is effectively eliminated. The next step is to measure the difference between peaks in the smoothed histograms to obtain erosion and/or dishing information using the data that is the most likely in Step 94 (described further in conjunction with FIGS. 7–10.) Note that what is measured is not the trench depth illustrated in FIG. 4 as H1–H4, but the actual dishing and erosion values from the topography map shown in FIG. 5.

Preferably, a conventional filter is used to filter the histograms, smooth the distribution and locate where peaks are, thus producing the smoothed curve. Notably, smoothing the data is not critical to the present invention, and those skilled in the art can readily determine peak values without undergoing undue experimentation.

In Step 96, method 80 determines whether any other regions of interest require analysis. If so, Steps 86–96 are repeated including selecting (Step 86) and leveling (Step 88) the region of interest, and then generating a corresponding histogram (Step 90). As described previously, the histogram is smoothed and the dishing/erosion regions are characterized. On the other hand, if there are no further regions of interest, the analysis of the topography data is terminated, or another metrology scan of the sample surface is performed to obtain more data.

These steps may be repeated over the entire surface of the sample being analyzed, or only over select portions thereof, to obtain predictable dishing/erosion values for a semiconductor. More particularly, the dishing and erosion data in a selected region (e.g., of a wafer) may be extrapolated to different portions of the sample due to the reproducibility and the general homogeneity of the manufacturing process. Overall, the steps of forming histograms and smoothing the histograms to produce smoothed curves, using known statistical methods and techniques, effectively eliminates negative effects associated with noise in the surface characterization data, rendering the result reproducible and reliable.

Figure 7:
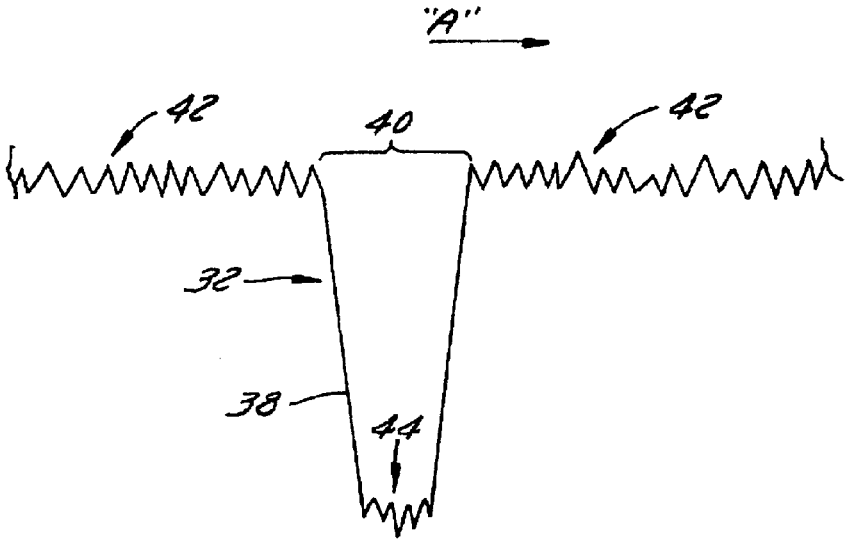
FIG. 7 is a plot depicting an enlarged portion of the data shown in FIG. 5.

Turning to FIG. 7, a region of interest R3, delineated as shown FIG. 5, is shown leveled, and on an enlarged scale relative thereto to highlight the region. Notably, the user selects particular regions of the topography data, such as that shown in FIGS. 5 and 7, by setting electronic markers around the region of interest R3. Region of interest R3 includes an illustrative dip 32 that has a sharp drop-off at 38 from the adjacent surface data (identified by regions 42 in FIG. 7). More particularly, dip 32 represents a single downward spike from the otherwise generally planar surface region 42 of semiconductor surface. Dip 32 extends across the region 40 along the direction of the horizontal arrow "A" in FIG. 7, and represents a single dishing region. Notably, the topography data generated from the horizontal scan along the semiconductor upper surface often includes noise, even in generally planar regions 42 (i.e., regions of no dishing or erosion). Further, a second noise signal 44 generally located at the low peak of dip 32 results when collecting topography generally horizontally along the bottom of dip 32, typically within a metal filled trench of the semiconductor.

After the single dishing region R3 (FIGS. 5 and 7) has been isolated on the left and right, and preferably leveled, region R3 may be identified and investigated. At this point, the data can be processed to accurately and precisely identify surface defects from the semiconductor surface characterization information. Overall, the process of the preferred embodiment provides the measurement of the depth of a dip or dips into a trench to assume reliability and reproducibility of the measurements. Further, the preferred embodiment is able to do so in the presence of noise, without such semiconductor surface characterization measurement being significantly affected by such noise.

Figure 8:
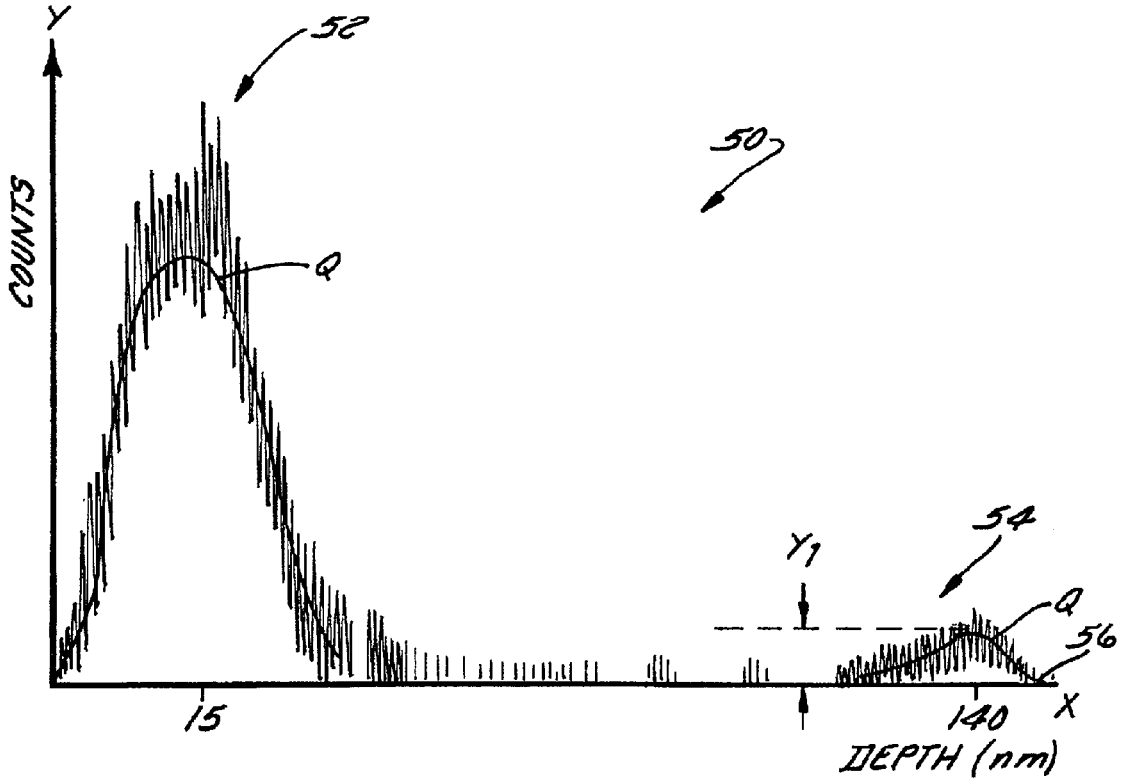
FIG. 8 is a histogram generated based on the surface topography data shown in FIG. 7, illustrating a step in a method of the preferred embodiment.

Next, according to the method of the preferred embodiment, a histogram 50 is generated from the collected topography data, such as that shown in FIG. 8 based on the single dishing topography data shown in FIG. 7 which corresponds to the selected region R3. In FIG. 8, measurement depth in nanometers (nm) is shown on the horizontal axis, while the vertical axis indicates the number of measurements or "counts" made at each depth. Note that the raw data plotted in FIG. 8 is preferably "smoothed" to generate the curve according to a conventional smoothing algorithm to provide more readily recognizable peaks of the corresponding histogram data. Smoothed histogram curve marked "Q" results.

Referring more particularly to histogram 50 shown in FIG. 8, two readily identifiable peaks 52, 54 are shown and represent the depths at which there is a high occurrence of topography data. Peak 52 is indicative of the surface of the sample and generally corresponds to a depth of about 15 nm. Peak 54 corresponds to the depth at which the single dishing 32 in FIG. 7 extends at its peak, which is about 140 nm. According to method 80 (Step 94), the difference in nanometers between the histogram peak positions 52 and 54 is the measured depth associated with the single dishing, in this case approximately 125 nm. Further, an extreme depth value is the difference between histogram peak position 52 and the rightmost point 56 on histogram 50 shown in FIG. 8, which corresponds to the peak depth of the dishing region which is about 155 nm. As a result, the extreme depth dishing measurement is approximately 155 nm minus 15 nm, or about 140 nm. Using the difference measurement based on the generated histogram, unlike conventional methods (for instance, using percentiles), dishing measurements can be readily made even in the presence of substantial noise.

A histogram can also be generated that is indicative of the rate of dishing, typically for a sample of the topography data larger than that marked by region R3, characterized by multiple dishing regions . The rate of dishing is often desired to assess the overall integrity of the manufacturing step. For a larger region, the measured depth will be similar to that shown in FIG. 8, i.e., the distance between the two readily identifiable peaks will generally be the same. However, the number of occurrences at the greater depth (histogram peak position 54) will be much greater. A greater number of occurrences or counts at a particular depth indicates typically a multiple dishing region.

Figure 9:
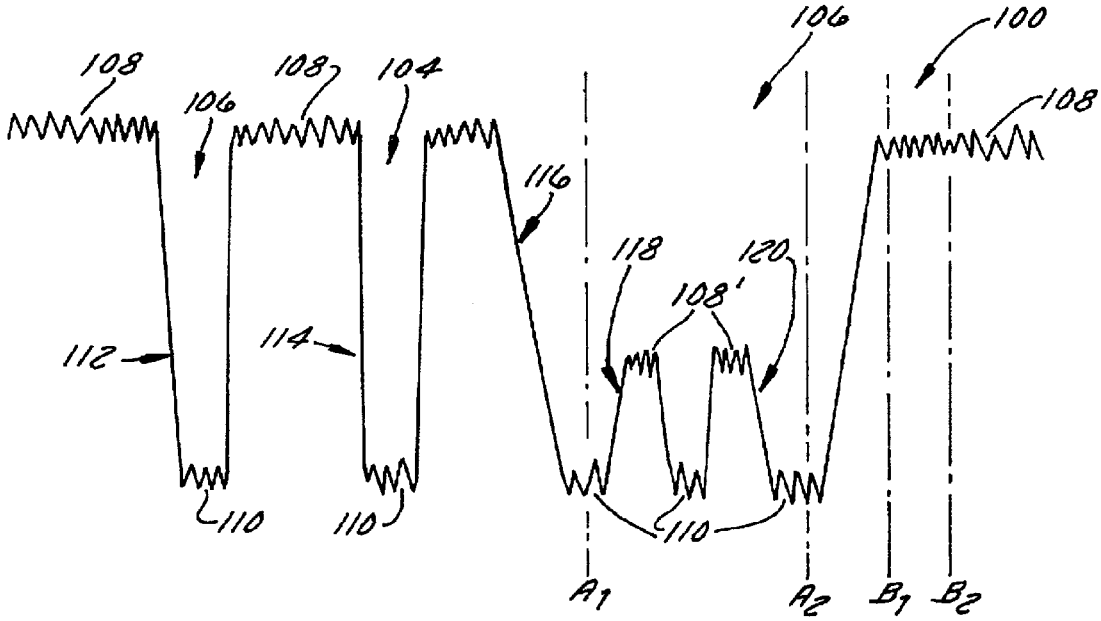
FIG. 9 is a plot depicting an enlarged portion topography data shown in FIG. 5.

FIG. 9 is another topography map, similar to FIG. 7, schematically characterizing a sample surface of the semiconductor, such as that shown in FIG. 4 and generally corresponding to the data shown in FIG. 5. Note that the data 100 in FIG. 9 is shown schematically to more readily illustrate the different aspects of the preferred embodiment. The topography data is shown leveled along the scan direction, according to Step 88 of method 80. Two single dishing zones 102 and 104 are shown, as well as an erosion and multiple dishing zone 106 (corresponding to region 36 in FIG. 5) of the sample surface. In addition, FIG. 9 illustrates upper or surface level noise signals 108 and 108' that result from a horizontal scan along the upper surface of the semiconductor, as well as lower level noise signals 110 that result when the scan traverses generally horizontally along the bottom of the dips 112, 114, 116, 118, and 120. Further in this regard, the erosion and multiple dishing zone 106 shown in FIG. 9 may correspond to data associated with a single trench 12' or a plurality of trenches 12, each of which contains the electrically-conductive metal 16, and each metal-filled trench 12 being separated by adjacent sidewalls 20 of the semiconductor 10 (FIG. 4).

Figure 10:
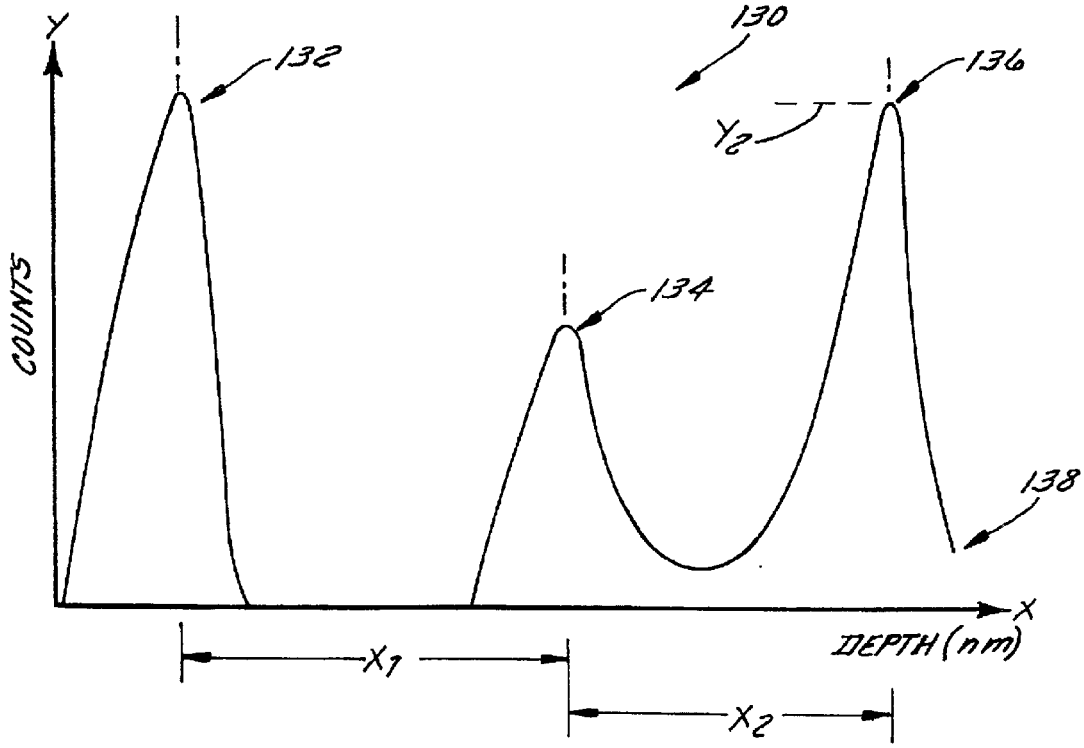
FIG. 10 is a histogram generated based on the surface topography data shown in FIG. 9, illustrating a step in the method of the preferred embodiment.

FIG. 10 is a histogram 130 showing distribution of heights in the surface area (e.g., corresponding to reference level or plane 33 in FIG. 5 over the region defined by markers set by a user, for example, "B1" and "B2" shown in FIG. 9), as well as the distribution of heights in the dishing and erosion zone (e.g., corresponding to levels or planes 35 and 37 in FIG. 5 over the region defined by markers set by a user, for example, "A1" and "A2" shown in FIG. 9). Note that, like the topography plots, histogram 130 is shown schematically to illustrate different aspects of the preferred embodiment. In this case, the point-by-point histogram 130 is smoothed as described previously to more readily determine the average peak position of the regions of interest, including the reference level, the dishing regions and the erosion regions. The distance "$X_1$" between a peak 132 representative of the semiconductor surface or reference level (33 in FIG. 5), and an erosion peak 134 (corresponding generally to level 35 in FIG. 5) representative of the erosion zone is a measure of the amount of erosion. On the other hand, the height of the peaks (i.e., the actual number of counts) reflects the number of data points used to generate the histogram (by setting the markers over a wider region of interest of the topography data), and thus can provide a more accurate measure of the amount of dishing or erosion. Such information is important, as it enables a semiconductor manufacturer to know when and how often erosion is occurring, which in turn enables a semiconductor manufacturer to control the process steps to minimize the rate and amount of erosion.

The distance "$X_2$" between erosion peak 134 representative of the new surface of the semiconductor (e.g., 18A in FIG. 4, generally corresponding to reference level 35 in FIG. 5) due to surface erosion, and the dishing peak 136 representative of surface dishing (e.g., 24 in FIG. 4, generally corresponding to reference level 37 in FIG. 5) is used to determine the level of dishing in the multiple dishing region 36. In this case, distance $X_2$ is approximately 155 nm (dishing peak) minus 85 nm (erosion peak associated with eroded semiconductor surface level), or about 70 nm. Such information enables a semiconductor manufacturer to know when dishing is occurring, which in turn enables user control over the process steps to ultimately minimize the rate of dishing, and amount.

Figure 1:
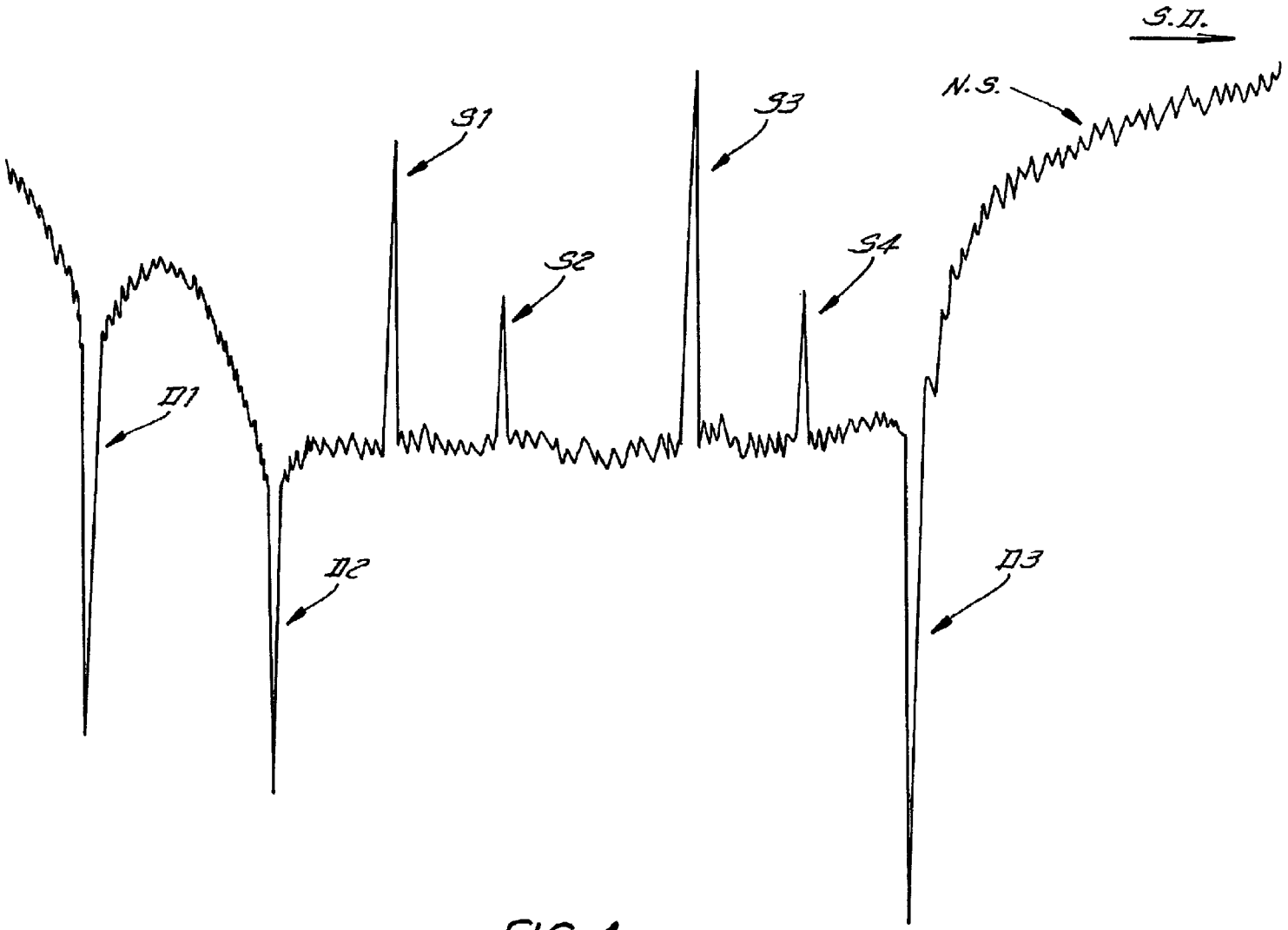
FIG. 1 is a plot of a surface profile, illustrating noise manifested as dips and spikes.
Figure 2A:
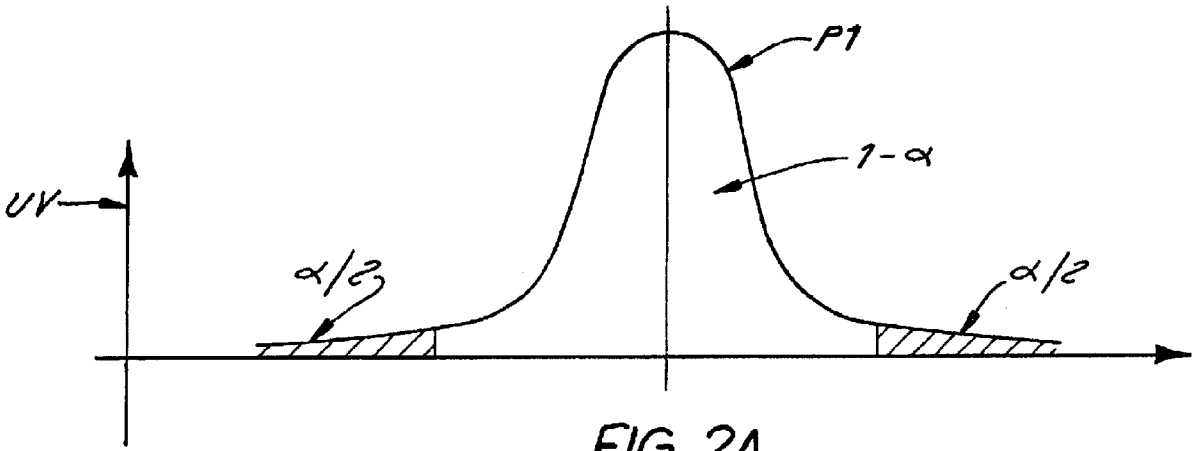
FIGS. 2A and 2B comprise a split plot, depict an actual sample surface on a lower horizontal axis, and probability on an upper horizontal axis.
Figure 2B:
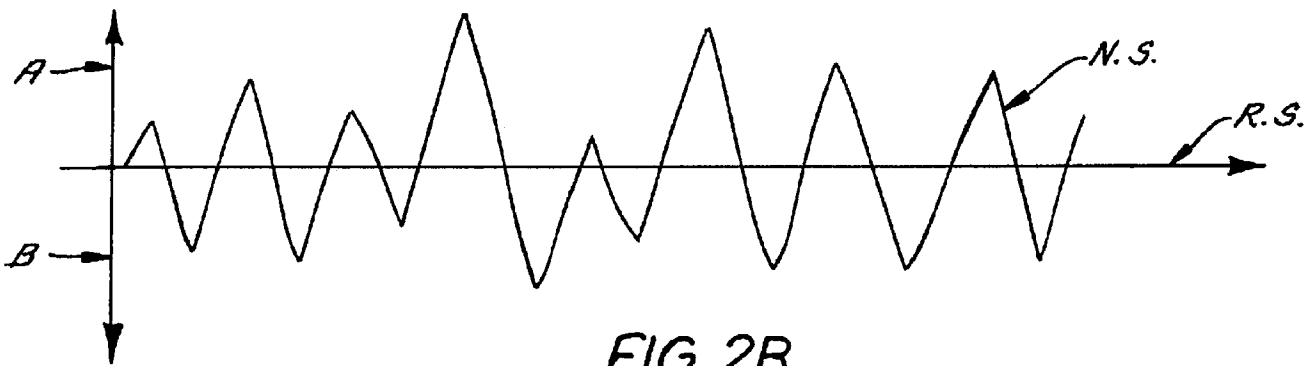

In FIG. 10, three distinct peaks are shown. Within the multiple dishing zone 106 (FIG. 9), one such peak will represent the statistically most likely value of the distance between the actual or true location of the bottom of a trench 20 or 12A (FIG. 3) relative to the actual or true location of the upper surface 28 of the wafer wall portion 24. Importantly, distances between peaks are used to determine most likely erosion and dishing values, and the effects of spikes (see, for example, FIG. 1 and the associated discussion above) are greatly reduced when data relating to spikes are plotted in a histogram and smoothed out, as shown in FIG. 10. For example, data relating to noise having a large magnitude preferably would be plotted in the region marked 138 in FIG. 10, because, although the depth of the noise data may be great, the comparative number of occurrences of that noise data is small in comparison to histogram data associated with the surface dishing and erosion regions. Because the preferred method determines the most likely topography points, the peaks correspond to the desired information, while points on the histogram in region 138, for example, are essentially filtered from the calculations.

Notably, the distance "$X_1$+$X_2$" which is the distance between the semiconductor surface peak 132 and the peak 136 corresponding to the multiple dishing region is generally equal to the distance between surface peak 52 and dishing peak 54 in FIG. 8 (approximately 125 nm), which corresponds to a region having a single dishing. In other words, the ultimate depth of dishing is the same for the data in FIGS. 7 and 9. However, the number of points at which this dishing level occurs is different for the data shown in FIGS. 7 and 9 and the desired dishing data is different due to the new (i.e., eroded) semiconductor surface. In particular, for the data shown in FIG. 9, where multiple dishing data is present, there are significantly more occurrences of topography data at that dishing depth, thus facilitating the determination of peaks that more accurately represent the "most likely" data. This is shown as count levels $Y_1$ and $Y_2$ in FIGS. 8 and 10, respectively, wherein $Y_2$ is $>Y_1$. This difference is the number of counts is in conjunction with associated data relating to scan length is illustrative of the rate of dishing.

In the case of "negative erosion" (described previously), the surface anomaly manifests itself as an eroded zone that is characterized as actually rising above the sample surface. Another way to describe it is as a dishing drop below the desired semiconductor surface, not in the metal filled trench region (as shown by trench dishing dip peak 32 in FIG. 5), but in the adjacent oxide regions (for example, 19 in FIG. 4). Again, this is due to the oxide being polished away below the approximate desired semiconductor surface, while the metal is polished generally right to the desired semiconductor surface (18 in FIG. 4, for example).

Figure 11:
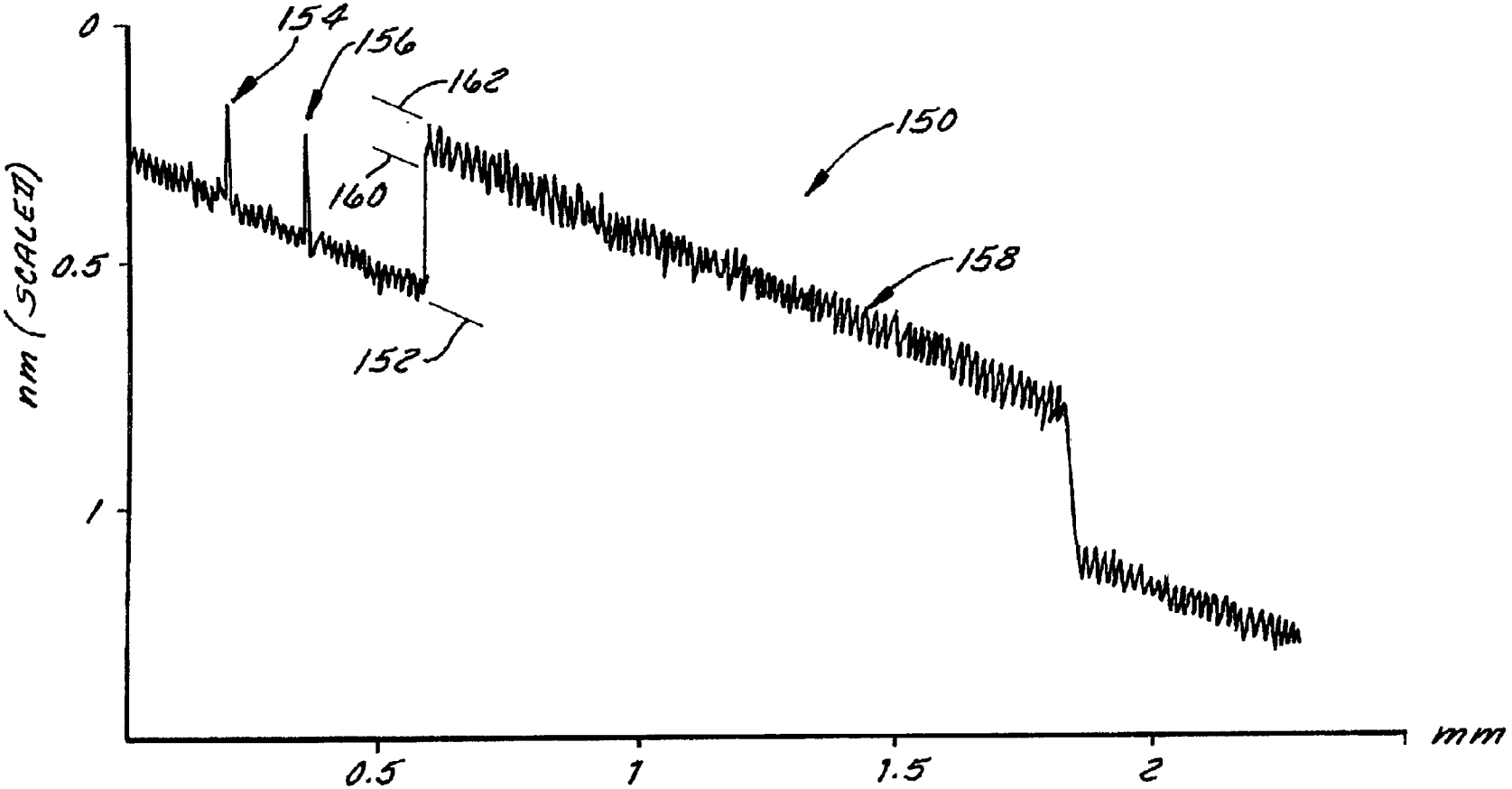
FIG. 11 is a plot of the topography of a surface of a semiconductor sample that is negatively eroded, and where the sample surface is slightly tipped.

Turning to FIG. 11, a profile 150 of the topography of a semiconductor surface that has been negatively eroded is shown. (Note that we hereinafter refer to the semiconductor in FIG. 4 in describing this phenomenon. The only difference now is that the metal is harder to wear away than the oxide.) Rather than the dishing drops in the metal filled trench regions illustrated in FIG. 5, the topography map is characterized as having surface characterization data above the level marked 152 corresponding to the worn away oxide of the semiconductor surface, and corresponding to the setpoint of the device (e.g., SPM) that is used image the surface. In particular, a pair of spikes 154, 156 are indicative of instances of negative erosion in, for example, the region of widely spaced trenches (12 in FIG. 4) where the metal did not wear away as fast as the oxide. In region 158 (corresponding to, for example, the region of tightly packed trenches 12' shown in FIG. 4), a significant width of the surface is negatively eroded, generally to a level marked 162. This result is realized because the oxide in region 14' of the substrate 14 (see FIG. 4) is worn away not only faster than the metal in the trenches, but faster than the oxide (e.g., 19A) in the regions between the tightly packed trenches 12' (see surface 19B in FIG. 4). In that regard, level 160 is indicative of the wearing away or multiple dishing of the oxide in the region between those trenches 12', i.e., in surface 19A. Again although the oxide of surface 19A does not wear away as fast as the oxide in region 14', in the case of negative erosion, it does wear away faster than the metal in the adjacent trenches 12'.

To make a negative erosion measurement according to the preferred embodiment, the oxide dishing, or negative erosion, data is then used, along with the other surface data in the topography map, to generate a histogram, as in FIG. 8. At least two peaks in the histogram will result. A first peak (similar to 52 in FIG. 8) corresponding to the non-eroded/dished oxide surface adjacent the metal filled trenches (for example, 12 in FIG. 4), and a second peak (similar to 54 in FIG. 8) corresponding to the surface in the so-called negatively eroded metal filled trenches (for example, 12 in FIG. 4 where the adjacent oxide/metal is worn away faster than at least a portion of the metal due, at least in part, to the difference in hardness.(rather than the dished metal (see 24 in FIG. 4), as shown in FIG. 8). The difference in the depths associated with these two peaks is a measure of the negative erosion.

To eliminate all of the noise signals that might otherwise affect the measurement, the above-described "histogram" method is employed. Note that in the above description, the term "histogram" is understood to mean a representation of a frequency distribution by means of rectangles whose widths represent class intervals and whose areas are proportional to the corresponding frequencies. The width of each such rectangle is desirably minimized, using known mathematical techniques and methods, to reduce the likelihood that statistically reliable "most likely" data relative to "actual" or "true" location of the reference surface as well as "actual" or "true" defects as distinguished from "false" defects are produced as a result. Those skilled in the art of statistics and probability are generally well aware of mathematical techniques and methods able to achieve such a result.

What has been illustrated and described herein is an improved method for measuring dishing values and erosion values of a semiconductor surface by scanning the surface.

Yet, it is important to bear in mind, as the improved method has been illustrated and described with reference to several preferred embodiments, it is to be understood that the invention is not to be limited to these embodiments. In particular, and as those skilled in the relevant art can appreciate, functional alternatives will become apparent after reviewing this patent specification. Accordingly, all such functional equivalents, alternatives, and/or modifications are to be considered as forming a part of the present invention insofar as they fall within the spirit and scope of the appended claims.

What is claimed is:

1. A method of characterizing a sample surface having a surface anomaly region, the method comprising:

profiling the sample surface to generate surface characteristic data that includes data indicative of a surface depth;

generating a histogram of a number of occurrences of the surface depth based on said profiling step; and measuring a surface anomaly in the surface anomaly region based generally only on said generating step.

2. The method of claim 1, further including the step of selecting a zone of interest from the surface characterization data.

3. The method of claim 2, wherein the zone of interest includes the surface anomaly region.

4. The method of claim 3, wherein the surface anomaly region includes one of erosion and dishing.

5. The method of claim 4, wherein the dishing is a single dishing.

6. The method of claim 1, wherein the histogram includes a first peak corresponding to a generally planar portion of the sample surface, and a second peak corresponding to the surface anomaly.

7. The method of claim 6, wherein said measuring step includes determining a distance between the first and second peaks.

8. The method of claim 7, wherein the distance is indicative of the depth of the surface anomaly.

9. The method of claim 6, wherein the surface anomaly region includes a plurality of surface anomalies, and wherein the histogram includes a third peak corresponding to a different surface anomaly, and wherein said measuring step includes determining a distance between the second and third peaks.

10. The method of claim 1, further including the step of smoothing the histogram.

11. The method of claim 10, wherein said smoothing step includes using a Gaussian filter.

12. The method of claim 1, further comprising the step of leveling the surface characteristic data.

13. The method of claim 1, wherein the histogram includes a first peak corresponding to a first depth associated with the surface characterization data, and a second peak corresponding to a second depth associated with the surface characteristic data.

14. The method of claim 13, wherein the first depth corresponds to a generally planar portion of the sample surface, and the second depth corresponds to the surface anomaly.

15. The method of claim 14, wherein the sample includes a metal-filled trench and the surface anomaly is associated with the trench.

16. The method of claim 15, wherein the surface anomaly is negatively eroded metal in the trench.

17. The method of claim 1, wherein said profiling step is performed using a probe-based instrument.

18. The method of claim 17, wherein the probe-based instrument is an atomic force microscope movable in a direction generally perpendicular to the sample surface.

19. The method of claim 1, wherein said profiling step is performed using a probe-based instrument, and the surface characteristic data is used to produce indicative of a three-dimensional image.

20. The method of claim 19, wherein the probe-based instrument is an atomic force microscope.

21. A method that measures dishing values and erosion values associated with topography data generated by scanning a semiconductor surface to obtain surface profile data comprises the steps of:

(A) generating a histogram of a number of occurrences of a surface depth associated with a portion of the surface profile data corresponding to a first zone of interest; and (B) smoothing the histogram of said generating step to produce a smoothed curve having a peak corresponding to one of a dishing value and an erosion value.

22. The method of claim 21, further including the step of repeating steps (A) and (B) relative to a plurality of additional zones of interest so as to produce smoothed curves including data relating to a corresponding dishing value or erosion value or both for each of the plurality of additional zones of interest.

23. The method of claim 21, further including the step of leveling the surface profile data prior to step (A).

24. The method of claim 21, further including the step of filtering the histogram after step (A) and prior to step (B).

25. The method of claim 21, wherein the first zone of interest includes dishing and erosion data, and wherein the smoothed histogram includes first, second and third peaks corresponding to a reference surface, an erosion value and a dishing value, respectively.

26. The method of claim 21, wherein a corresponding distance between select pairs of said first, second and third peaks is indicative of a corresponding one of the dishing value and the erosion value.

27. The method of claim 25, wherein the surface characteristic data is generated using a probe-based instrument.

28. A method for measuring dishing values and erosion values of a semiconductor surface by scanning the surface to obtain surface profile data that contains either dishing data or erosion data or dishing and erosion data, all referenced to surface data, wherein the improvement comprises the steps of:

(A) leveling the surface profile data, wherein the surface profile data is three-dimensional;

(B) generating a histogram of a portion of the leveled surface profile data corresponding to a first of a plurality of zones of interest;

(C) smoothing the histogram of said generating step to produce a smoothed curve having a maximum value corresponding to an erosion value or a dishing value; and (D) repeating steps (B) and (C) relative to each of the remainder of the plural zones of interest, to produce smoothed curves corresponding to an erosion value or a dishing value or both for each of the remainder of the plural zones of interest.

29. The improved method of claim 28, wherein the first zone of interest includes dishing and erosion values such that said smoothing step produces a smoothed curve having first and second maximum values corresponding to the dishing and erosion values, respectively.

30. The method of claim 28, wherein the surface characteristic data is generated using a probe-based instrument.

31. A method of characterizing a sample surface having a surface anomaly region, the method comprising:

profiling the sample surface to generate surface characteristic data;

generating a histogram based on said profiling step;

measuring a surface anomaly in the surface anomaly region based on said generating step; and wherein the histogram includes a first peak corresponding to a generally planar portion of the sample surface, and a second peak corresponding to the surface anomaly.

32. A method of characterizing a sample surface having a surface anomaly region, the method comprising:

profiling the sample surface to generate surface characteristic data;

generating a histogram based on said profiling step;

measuring a surface anomaly in the surface anomaly region based on said generating step; and wherein the histogram includes a first peak corresponding to a first depth associated with the surface characterization data, and a second peak corresponding to a second depth associated with the surface characteristic data.

33. A method that measures dishing values and erosion values associated with topography data generated by scanning a semiconductor surface to obtain surface profile data comprises the steps of:

(A) generating a histogram of a portion of the surface profile data corresponding to a first zone of interest, wherein the surface profile data is three-dimensional;

(B) smoothing the histogram of said generating step to produce a smoothed curve having a peak corresponding to one of a dishing value and an erosion value; and (C) wherein the first zone of interest includes dishing and erosion data, and wherein the smoothed histogram includes first, second and third peaks corresponding to a reference surface, an erosion value and a dishing value, respectively.

* * * * *

UNITED STATES PATENT AND TRADEMARK OFFICE

CERTIFICATE OF CORRECTION

PATENT NO. : 6,816,806 B2
DATED : November 9, 2004
INVENTOR(S) : Kocimski

It is certified that error appears in the above-identified patent and that said Letters Patent is hereby corrected as shown below:

Column 14,
Line 6, "indicative of" should be removed to read -- produce a three -- not "produce indicative of a three"

Signed and Sealed this

Tenth Day of May, 2005

JON W. DUDAS
*Director of the United States Patent and Trademark Office*